US006224723B1

(12) United States Patent
Prengaman et al.

(10) Patent No.: US 6,224,723 B1
(45) Date of Patent: May 1, 2001

(54) ELECTROWINNING ANODES WHICH RAPIDLY PRODUCE A PROTECTIVE OXIDE COATING

(75) Inventors: R. David Prengaman; Clifford E. Morgan, both of Arlington, TX (US)

(73) Assignee: RSR Technologies, Inc., Dallas, TX (US)

( * ) Notice: Subject to any disclaimer, the term of this patent is extended or adjusted under 35 U.S.C. 154(b) by 0 days.

(21) Appl. No.: 09/603,707

(22) Filed: Jun. 27, 2000

Related U.S. Application Data

(63) Continuation-in-part of application No. 09/229,535, filed on Jan. 13, 1999, now abandoned.

(51) Int. Cl.[7] ..... C25B 11/04

(52) U.S. Cl. ..... 204/293; 420/563; 420/566; 148/706

(58) Field of Search ..... 204/293; 205/252, 205/369, 559, 571, 602, 603, 609; 420/566, 563; 148/706

(56) References Cited

U.S. PATENT DOCUMENTS 4,364,807 * 12/1982 von Röpenack et al. ..... 204/293
4,373,654 * 2/1983 Prengaman et al. ..... 204/293

* cited by examiner

*Primary Examiner*—Bruce F. Bell
(74) *Attorney, Agent, or Firm*—Theresa M. Gillis

(57) ABSTRACT

An anode for use in zinc electrowinning is described. The anode is made of a lead-silver alloy which has been cast as a billet rolled and subjected to heat treatment either during or after rolling. The temperature of treatment is high enough to cause recrystallization of the alloy and to prevent precipitation of any alloying elements. The anode has a surface grain structure which facilitates rapid oxidation of the anode to condition the anode. The anode preferably contains at least 0.03 to 0.45% silver and Lip to 0.08% calcium.

16 Claims, No Drawings

ELECTROWINNING ANODES WHICH RAPIDLY PRODUCE A PROTECTIVE OXIDE COATING

This application is a continuation-in-part of Ser. No. 09/229,535, filed Jan. 13, 1999, now abandoned.

FIELD OF THE INVENTION

This invention relates to an improved electrowinning anode particularly for zinc electrowinning. The anode consists of a rolled lead-silver alloy, preferably a lead-calcium-silver alloy, with controlled surface grain structure. Because the anode is used in zinc electrowinning, it should contain no tin. The surface grain structure is formed by a combination of anode chemistry, rolling and heating, preferably while rolling. When placed in a zinc electrowinning cell, the anode surface is rapidly covered with an adherent oxide coating.

BACKGROUND OF THE INVENTION

A zinc electrowinning tankhouse uses cast lead-silver alloy anodes. Silver is added to lead anodes for electrowinning to reduce the rate of corrosion of the anodes in use. Lead anodes used in zinc electrowinning generally contain 0.5–1.0% silver. Lead-silver anodes used for zinc electrowinning contain no tin because tin will plate on the negative anode and prevent zinc deposits.

To produce good quality zinc the cathode in an electrowinning cell must contain less than 10 ppm lead. In order to reduce lead contamination of the cathode, the lead anode must be coated with a protective layer of $PbO_2/MnO_2$. The silver present in the anode decreases the rate of initial oxidation of the anode surface leading to an extended time period before a stable oxide film is produced. Conditioning new anodes by developing a $PbO_2$ /$MnO_2$ layer on the surface normally takes many weeks. The complete formation of this layer may take as long as 60–90 days. Until the anode is fully conditioned, the zinc cathodes in electrowinning cells experience high lead contents, high numbers of nodules and poor current efficiency. In addition, zinc production is substantially reduced as manganese ions are recirculated between anode and cathode as $MnO_2$ spalled off the anode is reduced at the cathode to produce $MnSO_4$. The production of zinc from a cell containing new unconditioned anodes may produce as much as one-third less zinc than corresponding conditioned cells.

Once a stable layer of $PbO_2/MnO_2$ is formed on the anode, the current efficiency of the zinc electrowinning process increases dramatically, and the lead contamination of the resultant cathodes also decreases dramatically. Production of a stable $PbO_2$, or $PbO_2/MnO_2$ layer via pretreatment of the anode is described by Ecgett et al. in U.S. Pat. No. 3,880,733, Gaunce et al. in U.S. Pat. No. 3,392,094, Fountain et al. in U.S. Pat. No. 3,755,112, as well as R. H. Farmer in "Electrometallurgy" ed. H. Baker 1969. As described therein, a stable $PbO_2$ layer/$MnO_2$ layer is typically created by the immersion of the anodes in a preconditioning solution in which the anodes are electrolyzed to produce corroded layers. In some cases the anodes are first immersed in water or water and air to produce a PbO, $Pb(OH)_2$, or $PbCO_3$ film which is more readily oxidized to a protective $PbO_2$ layer than the normal cast or rolled surface. Rodrigues and Meyer, in "EPD Congress 1996" ed. G. Warren, describe the use of sandblasting to aid in preconditioning anodes.

Lead-silver alloy anodes are relatively weak. In use, they can become warped and bent leading to short circuits between the anode and cathode, low current efficiency, and lead contamination of the cathodes in the area of the short circuit. To improve the mechanical properties of the lead-silver anodes alloying elements such as calcium, strontium, barium and others have been added to the anodes to improve the mechanical properties. For example, UK patent application GB 2149424A by M. J. Thorn teaches an alloy containing 0.4–1.0% Ag, 0.05–0.15% Ca/Sr, less than 0.0002% antimony and optionally barium to reduce calcium losses during remelting.

Production of cast lead-silver or lead-silver-calcium anodes often results in the formation of numerous holes, voids or laps in the anode surface. In use, these can initiate internal corrosion in localized areas which can weaken the anode and cause warping. When the anodes are periodically cleaned of the adhering $MnO_2$ deposit, the internal corrosion may cause cracking which can lead to premature anode failure.

To reduce the presence of internal porosity or laps, lead-silver or lead-calcium-silver alloys have been rolled into sheets. These sheets have been joined to a copper busbar by various means but primarily by welding the rolled sheet to lead which has been cast around the copper busbar. The rolled sheet generally has a smooth surface on which it is more difficult for the $PbO_2/MnO_2$ corrosion product to produce an adherent film. In addition, the grail structure is uniform and is oriented in the rolling direction producing a grain structure with few grain boundaries available for corrosion and attachment of the oxidized film.

The improvement taught by this invention is the rolling of a cast billet of lead-silver alloys and treatment of the alloy during or after rolling at a temperature sufficiently high to produce a surface on which the $PbO_2/MnO_2$ layer more readily adheres due to a grain structure having many grain boundaries. The grain structure is nonuniform (i.e., not oriented in the rolling direction). These anodes have more satisfactory mechanical characteristics than prior art cast anodes and can be conditioned much more rapidly than prior art rolled anodes.

SUMMARY OF THE INVENTION

This invention relates to a lead-silver anode for zinc electrowinning having a randomly oriented grain structure with many grain boundaries. The anode is formed by rolling a cast lead-silver alloy and heat treating the alloy either during or after rolling at a temperature sufficiently high to cause recrystallization of the alloy and to prevent most or all of any calcium, barium and/or strontium present in the alloy from precipitating from solution. Because the anode is used for zinc electrowinning it contains 0% tin. In anodes formed via this procedure, finely divided silver particles form during solidification and prevent gross grain structure growth while the high temperatures result in a material with a recrystallized grain structure with many grain boundaries. The material is also without stresses induced by rolling. A temperature greater than about 100° C.and preferably above about 150° C. is typically required to produce the proper grain structure.

DETAILED DESCRIPTION OF THE INVENTION

In accordance with the invention, a lead-silver anode containing 0% tin for use in zinc electrowinning, is formed preferably by rolling a cast lead-silver alloy at a temperature high enough to cause recrystallization of the alloy. The temperature is also high enough to prevent precipitation of any alloying elements, such as barium, calcium or strontium, during the rolling process. As a result, an alloy is formed having, a grain structure with many grain boundaries to which the $PbO_2/MnO_2$ layer may adhere more readily than in prior art alloys rolled at lower temperatures.

A lead alloy suitable for use in the practice of the invention may contain as little as about 0.30–0.45% silver. A preferred alloy also contains no more than about 0.08% calcium and preferably at least 0.03% calcium. A more preferred alloy contains about 0.04–0.07% calcium and about 0.3 to 0.5% silver, most preferably about 0.065% calcium and about 0.35% silver. The alloy may contain other alloying elements, including barium, strontium and other materials which enhance the mechanical properties of an anode. The alloy may also contain small amounts of aluminum to reduce the oxidation of the reactive alloying elements. The alloy must not contain any tin as tin will prevent zinc from depositing.

If the silver content of the lead alloy used to make the anode of the invention is too low, there are insufficient silver particles to restrict the growth of the grains during the hot rolling process. If the silver content is too high, the cost of the alloy is excessive.

If the calcium content of the lead alloy is too low, the improved mechanical properties attributable to calcium will not be achieved. If the calcium content of the invention is higher than about 0.08%, primary $Pb_3Ca$ particles may precipitate from solution during the solidification process and float to the surface of the billet. This will result in an enrichment in calcium on one side of the rolled anode sheet compared to the remainder of the sheet. During use the side enriched in calcium will corrode preferentially causing warping, short circuits, reduced current efficiency and lead contamination of the cathode. The higher the calcium content of the anode above 0.08%, the higher is the differential rate of corrosion between faces and the more likely warping will occur in these rolled anodes.

If a billet is cast in a book mold prior-r to rolling from an alloy containing a calcium content higher than 0.08%, the primary $Pb_3Ca$ particles will form a layer near the center line. During rolling the layer of particles will form a concentrated seam of calcium rich particles at the center of the sheet. When the sheet is cut and assembled into anodes, the high calcium content central areas will corrode preferentially causing delamination and fanning of the edges of the anode sheet. These defects can cause short circuits as well as lead contamination of the cathode.

With calcium contents between about 0.03 and 0.08%, all the calcium remains in solution during the solidification process and the billet has a uniform calcium content throughout. Rolling this material at the preferred temperature produces a uniform grain structure consisting of silver particles in a matrix of lead and calcium.

An alternative method of forming the anode of the invention consists of cold rolling the cast alloy. The cold rolled anodes are treated by heating to a temperature of about 150° C. or above. Heating removes the effects of the cold rolling and produces a grain structure on which a stable oxide film can be formed rapidly. If an anode sheet containing calcium is rolled below 100° C. (cold rolling), some of the calcium can precipitate during the rolling operation. This a precipitation, when combined with the silver content of the anode, can produce work hardening of the sheet. The hardened sheets can warp when some of the cold work is removed at tankhouse temperatures. Heating the anode sheet to a temperature above 150° C. before use reverses the effects of calcium precipitation and the effects of cold rolling.

The grains of alloy sheets formed in accordance with the invention are randomly oriented instead of being oriented in the rolling direction, as is the case with prior art rolled alloys. This random orientation of fine grains with many grain boundaries presents a large grain boundary surface area in all regions of the surface. When an anode incorporating the rolled alloy is oxidized to produce a $PbO_2/MnO_2$ layer, the oxidation is preferential to the grain boundaries and the $PbO_2/MnO_2$ product attaches itself to these grain boundaries and rapidly covers the adjacent surface. Therefore, the anodes of the present invention can be much more rapidly conditioned than prior art anodes.

EXAMPLE

A lead-0.06% Ca-0.35% Ag alloy billet was hot rolled in a manner such that the temperature of the cast billet remained above 150° C. during the rolling process. Sheets were attached to copper busbars via the process described by U.S. Pat. No. 5,172,850. The resultant anodes were added as a full cell to a zinc electrowinning tankhouse. The anodes developed an adherent layer of $PbO_2/MnO_2$ within two days and produced high current efficiency and low cathode lead contents from the first week of operation.

What is claimed is:

1. An anode for electrowinning zinc comprising a rolled lead-silver alloy containing greater than 0% of a member selected from the group consisting of calcium, barium and strontium, containing 0% tin and having a randomly oriented grain structure.

2. The anode of claim 1 in which the alloy is a lead-calcium-silver alloy.

3. The anode of claim 2 in which the calcium content is below 0.08%.

4. The anode of claim 2 in which the calcium content is between 0.03 and 0.08%.

5. The anode of claim 2 in which the silver content is at least 0.3%.

6. The anode of claim 2 in which the silver content is between 0.3 and 0.5%.

7. The anode of claim 2 in which the calcium content is between 0.04 and 0.07% and the silver content is between 0.3 and 0.4%.

8. The anode of claim 2 in which the calcium content is about 0.06% and the silver content is about 0.35%.

9. The anode of claim 1 in which the rolled alloy is attached to a copper busbar.

10. The anode of claim 1 in which the alloy contains barium.

11. The anode of claim 1 in which the alloy contains strontium.

12. A lead-silver alloy for electrowinning zinc containing greater than 0% of a member selected from the group consisting of calcium, barium and strontium, containing 0% tin and having a randomly oriented grain structure which is not corrosion resistant.

13. An anode for electrowinning, zinc formed by rolling a lead-silver alloy containing greater than 0% of a member selected from the group consisting of calcium, barium and strontium and 0% tin, and heat treating the alloy at a temperature sufficiently high to cause recrystallization of the alloy and to reduce precipitation fron solution of any calcium, barium or strontium present in the alloy.

14. The anode of claim 13 which is formed by rolling the alloy at a temperature above 100° C.

15. The anode of claim 13 which is formed by rolling the alloy at a temperature above 150° C.

16. The anode of claim 13 which is formed by rolling the alloy at a temperature below 150° C. and heat treated above 150° C., whereby a fine grained recrystallized structure is formed.

* * * * *

US006224723C1

(12) EX PARTE REEXAMINATION CERTIFICATE (9860th)

United States Patent

Prengaman et al.

(10) Number: US 6,224,723 C1

(45) Certificate Issued: Oct. 4, 2013

(54) ELECTROWINNING ANODES WHICH RAPIDLY PRODUCE A PROTECTIVE OXIDE COATING

(76) Inventors: R. David Prengaman, Arlington, TX (US); Clifford E. Morgan, Arlington, TX (US)

Reexamination Request:
No. 90/011,980, Oct. 24, 2011

Reexamination Certificate for:

| | |
|---|---|
| Patent No.: | **6,224,723** |
| Issued: | **May 1, 2001** |
| Appl. No.: | **09/603,707** |
| Filed: | **Jun. 27, 2000** |

Related U.S. Application Data

(63) Continuation-in-part of application No. 09/229,535, filed on Jan. 13, 1999, now abandoned.

(51) Int. Cl.
*C25B 11/04* (2006.01)

(52) U.S. Cl.
USPC ..... 204/293; 148/706; 420/563; 420/566

(58) Field of Classification Search
None
See application file for complete search history.

(56) References Cited

To view the complete listing of prior art documents cited during the proceeding for Reexamination Control Number 90/011,980, please refer to the USPTO's public Patent Application Information Retrieval (PAIR) system under the Display References tab.

*Primary Examiner* — Timothy Speer

(57) ABSTRACT

An anode for use in zinc electrowinning is described. The anode is made of a lead-silver alloy which has been cast as a billet rolled and subjected to heat treatment either during or after rolling. The temperature of treatment is high enough to cause recrystallization of the alloy and to prevent precipitation of any alloying elements. The anode has a surface grain structure which facilitates rapid oxidation of the anode to condition the anode. The anode preferably contains at least 0.03 to 0.45% silver and Lip to 0.08% calcium.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2-6 are cancelled.

Claims 1, 7, 8, 12 and 13 are determined to be patentable as amended.

Claims 9-11 and 14-16, dependent on an amended claim, are determined to be patentable.

New claims 17-28 are added and determined to be patentable.

1. An anode for electrowinning zinc comprising a rolled [lead-silver] *lead-calcium-silver* alloy containing [greater than 0% of a member selected from the group consisting of calcium, barium and strontium, containing 0% tin and having a randomly oriented grain structure]*:*

*aluminum;*

*0.3% to 0.5% silver;*

*0.03% to 0.08% calcium;*

*0% tin; and*

*lead and incidental impurities;*

*wherein the rolled alloy anode is characterized by a randomly oriented grain structure that exhibits increased oxidation as compared to cast anodes.*

7. The anode of claim [2] *1* in which the calcium content is between 0.04 and 0.07% and the silver content is between 0.3 and 0.4%.

8. The anode of claim [2] *1* in which the calcium content is about 0.06% and the silver content is about 0.35%.

12. A [lead-silver] *rolled lead-calcium-silver* alloy for electrowinning zinc containing [greater than 0% of a member selected from the group consisting of calcium, barium and strontium, containing 0% tin and having a randomly oriented grain structure which is not corrosion resistant]*:*

*aluminum;*

*0.3% to 0.5% silver;*

*0.03% to 0.08% calcium;*

*0% tin; and*

*lead and incidental impurities;*

*wherein the rolled alloy is characterized by a randomly oriented grain structure that exhibits increased oxidation as compared to cast anodes.*

13. An anode for electrowinning, zinc formed by rolling a [lead-silver] *lead-calcium-silver* alloy containing [greater than 0% of a member selected from the group consisting of calcium, barium and strontium and 0% tin, and]*:*

*aluminum;*

*0.3% to 0.5% silver;*

*0.03% to 0.08% calcium;*

*0% tin; and*

*lead and incidental impurities; and* heat treating the alloy at a temperature sufficiently high to cause recrystallization of the alloy and to reduce precipitation [fron] *from* solution of [any] *the* calcium[, barium or strontium present in the alloy]*;*

*wherein the rolled and heat treated alloy anode is characterized by a randomly oriented grain structure that exhibits increased oxidation as compared to cast anodes.*

*17. The anode of claim 1, wherein the alloy grain structure includes silver particles in a lead and calcium matrix.*

*18. The alloy of claim 12, wherein the alloy grain structure includes silver particles in a lead and calcium matrix.*

*19. The anode of claim 13, wherein the alloy grain structure includes silver particles in a lead and calcium matrix.*

*20. The anode of claim 1, further comprising a $PbO_2$ layer attached to the anode at surface grain boundaries of the randomly oriented grain structure.*

*21. The alloy of claim 12, further comprising a $PbO_2$ layer attached to the alloy at surface grain boundaries of the randomly oriented grain structure.*

*22. The anode of claim 13, further comprising a $PbO_2$ layer attached to the anode at surface grain boundaries of the randomly oriented grain structure.*

*23. The anode of claim 1, further comprising a $PbO_2/MnO_2$ layer attached to the anode at surface grain boundaries of the randomly oriented grain structure.*

*24. The alloy of claim 12, further comprising a $PbO_2/MnO_2$ layer attached to the alloy at surface grain boundaries of the randomly oriented grain structure.*

*25. The anode of claim 13, further comprising a $PbO_2/MnO_2$ layer attached to the anode at surface grain boundaries of the randomly oriented grain structure.*

*26. The anode of claim 1, wherein the randomly oriented grain structure that exhibits increased oxidation is formed by separate rolling and heat treatment steps.*

*27. The alloy of claim 12, wherein the randomly oriented grain structure that exhibits increased oxidation is formed by separate rolling and heat treatment steps.*

*28. The anode of claim 13, wherein the randomly oriented grain structure that exhibits increased oxidation is formed by separate rolling and heat treatment steps.*

* * * * *